United States Patent [19]

Mastman et al.

[11] Patent Number: 4,753,189

[45] Date of Patent: Jun. 28, 1988

[54] MEDICINE BOTTLE CAP HAVING DOSAGE MEANS

[75] Inventors: Gary J. Mastman, 20777 Russell Ct., Saratoga; Sheldon Wiley, 865 Valley View Rd., Ben Lomond; Brian S. Santo, San Jose, all of Calif.

[73] Assignees: Gary J. Mastman, Saratoga; Sheldon Wiley, Ben Lomond, both of Calif.

[21] Appl. No.: 915,938

[22] Filed: Oct. 6, 1986

Related U.S. Application Data

[63] Continuation of Ser. No. 579,223, Feb. 10, 1984, abandoned.

[51] Int. Cl.[4] ..... G09F 9/00

[52] U.S. Cl. ..... 116/308; 206/534; 215/222; 116/311

[58] Field of Search ..... 116/308, 311, 312, 315; 206/534; 215/222

[56] References Cited

U.S. PATENT DOCUMENTS

| | | | |
|---|---|---|---|
| 3,151,599 | 10/1964 | Livingston | 116/308 |
| 4,011,829 | 3/1977 | Wachsmann et al. | 116/308 |
| 4,220,247 | 9/1980 | Kramer | 116/308 |
| 4,365,722 | 12/1982 | Kramer | 206/534 |
| 4,383,619 | 5/1983 | Mumford et al. | 215/222 |
| 4,399,920 | 8/1983 | Swartzbaugh et al. | 215/222 |
| 4,432,300 | 2/1984 | Lyss | 116/308 |
| 4,434,903 | 3/1984 | Cooke | 215/222 |
| 4,482,068 | 10/1984 | Agbay | 116/308 |
| 4,489,834 | 12/1984 | Thackrey | 116/308 |
| 4,528,933 | 7/1985 | Allen | 116/308 |

*Primary Examiner*—William A. Cochlinski, Jr.
*Assistant Examiner*—Thomas B. Will
*Attorney, Agent, or Firm*—Townsend and Townsend

[57] ABSTRACT

A medicine bottle unit having a closure for indicating dosage and other information which changes automatically as the closure is rotated on the bottle of the unit. The closure includes an outer cap and an inner member within the cap. The cap and inner member have cooperable indicia thereon. The inner member moves with the cap as the cap is rotated in one direction on the bottle. However, the cap moves relative to the bottle and the inner member when the cap is rotated in the opposite direction on the bottle, thus assuring a change in the information represented by the indicia on the cap and the indicator on the inner member, or by indicia on the inner member visible through a hole in the cap. Several embodiments of medicine bottle unit are disclosed.

20 Claims, 4 Drawing Sheets

FIG. 4
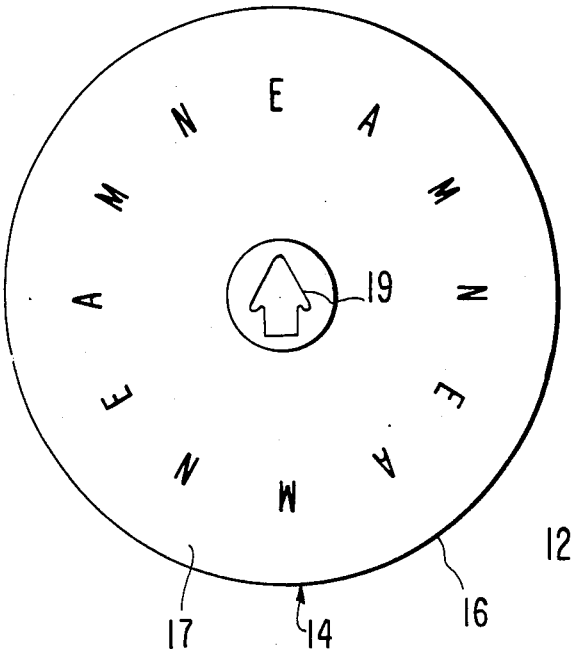
FIG. 5
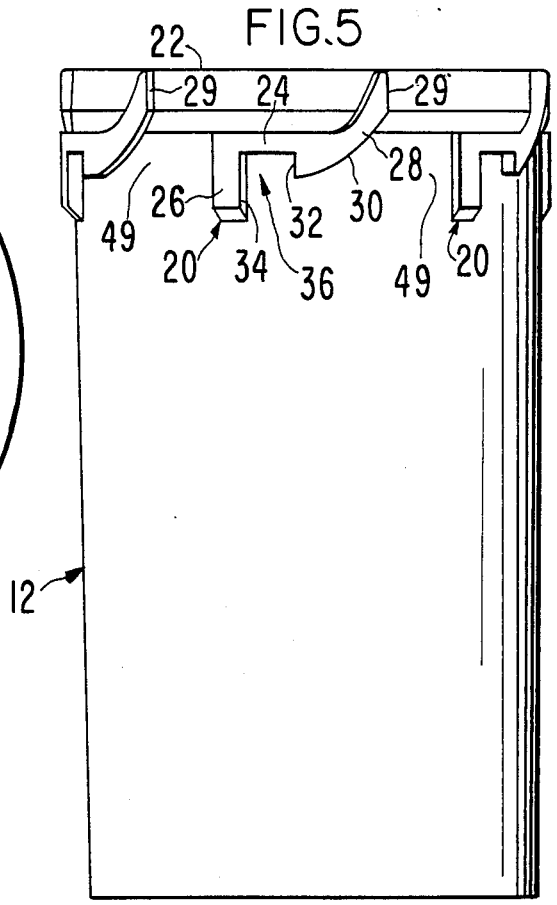
FIG. 6
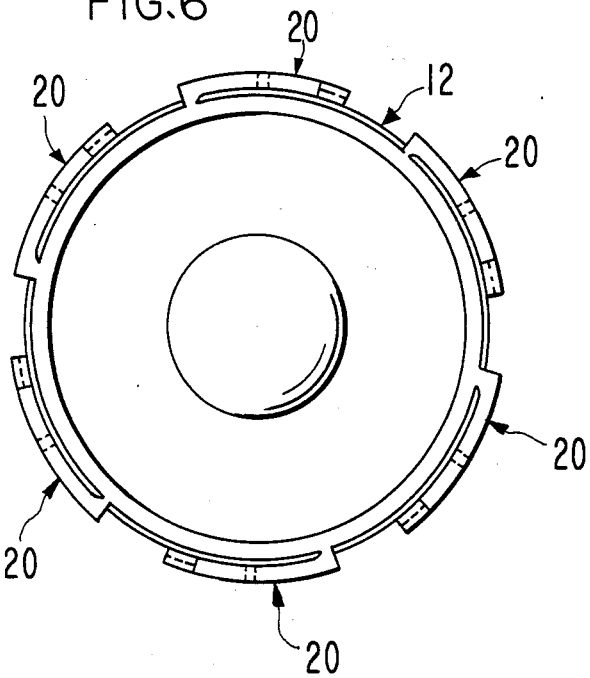
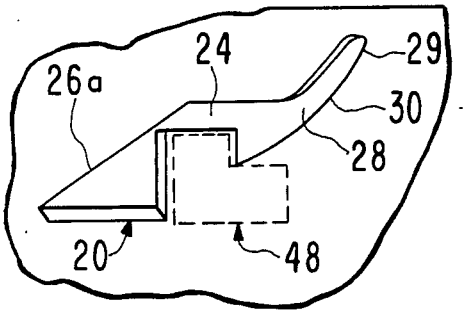
FIG. 5a

MEDICINE BOTTLE CAP HAVING DOSAGE MEANS

This is a continuation of application Ser. No. 579,223, filed 2/10/84, now abandoned.

BACKGROUND OF THE INVENTION

This invention relates to improvements in medicine bottles of the type having shiftable closures or caps, and more particularly, to such a medicine bottle having cap with dosage indicating information thereon.

Dosage indicating closures for medicine bottles have been known and used in the past. Disclosures of closures of this type are found in the following U.S. patents:

| | |
|---|---|
| 3,151,599 | 3,904,075 |
| 3,355,067 | 3,960,713 |
| 3,572,282 | 4,041,628 |
| 3,888,375 | 4,220,247 |

For the most part, the closures of these patents are generally complex in construction, require intricate molding of parts, and are not completely reliable in operation. Because of these drawbacks, a need has arisen for an improved medicine bottle unit having a closure which is simple and rugged in construction, has relatively few parts, can be inexpensively made, and is highly reliable in operation.

SUMMARY OF THE INVENTION

The present invention satisfies the aforesaid need by providing a medicine bottle unit having a closure comprised only of a relatively few parts, namely an outer, hollow cap member, and an inner member within the cap and cooperating with the cap to provide changeable dosage information. The closure has indicia on one of the members and an indicator on the other member, the indicator being moved incrementally from one location to the other to indicate the time for the next dosage when the closure is removed from or replaced on a medicine bottle, following the removal of medicine therefrom.

The bottle and cap may be provided with a safety cap feature including bosses on the cap and bottle. Such safety feature requires downward pressure on the cap relative to the bottle and then rotation of the cap on the bottle before the cap can be removed from the bottle itself.

In a preferred embodiment of the invention, the cap has spaced, inner peripheral grooves which cooperate with spaced, outer peripheral projections on the inner member. The projections are removably received in the grooves and cause the cap and the inner member to rotate as a unit relative to the bottle when the cap is rotated in one direction, such as when the cap is to be taken off the bottle. When the cap is removed from or replaced on the bottle, the grooves and projections allow rotation of the cap relative to the inner member so that the indicator on the inner member will be advanced incrementally and relative to the cap to indicate the time of the next dosage or some other information. The inner member has means including a number of circumferentially spaced legs which engage the outer peripheral bosses on the bottle to prevent rotation of the inner member relative to the bottle when the cap is removed from or replaced on the bottle following the removal of medication from the bottle. In this way, the indicator on the inner member is shifted relative to the cap automatically and without the attention of the user to verify that the next dosage time is properly indicated.

The primary object of the present invention is to provide an improved medicine bottle unit having a closure which is simple and rugged in construction is highly reliable at all times to indicate the next dosage time or other information for the user, and which is comprised only of a relatively few parts to minimize production and assembly costs while providing a positive closure for the medicine bottle itself.

Another object of the present invention is to provide an improved closure for a medicine bottle where the medicine bottle has an outer cap which receives an inner member, wherein the inner member is locked against rotation relative to the cap in one direction but can rotate relative to the cap in the opposite direction through a limited arc so that the closure is suitable for providing dosage information with respect to the medicine contained in the bottle on which the closure is used.

Other objects of this invention will become apparent as the following specification progresses, reference being had to the accompanying drawings for an illustration of the invention.

IN THE DRAWINGS

FIG. 4 is a top plan view of the cap;

FIG. 5 is a side elevational view of the bottle;

Figure 7:
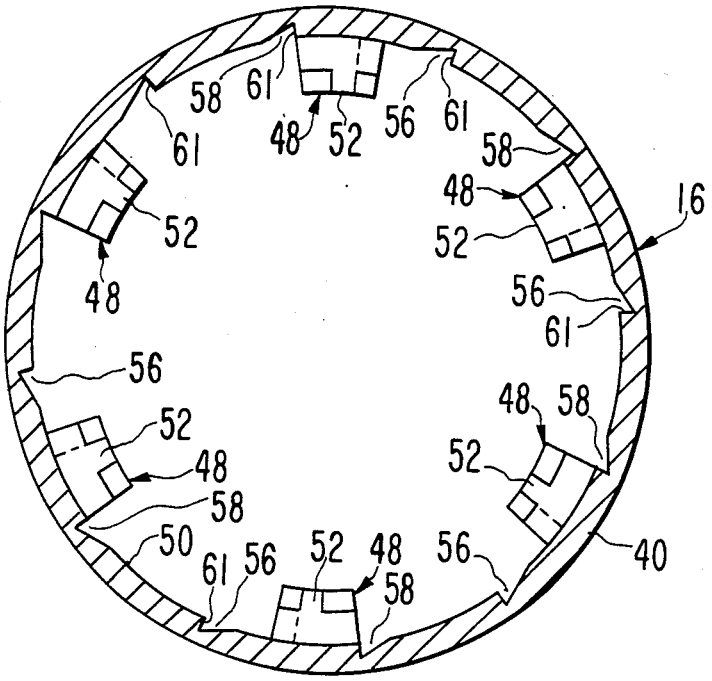
Figure 8:
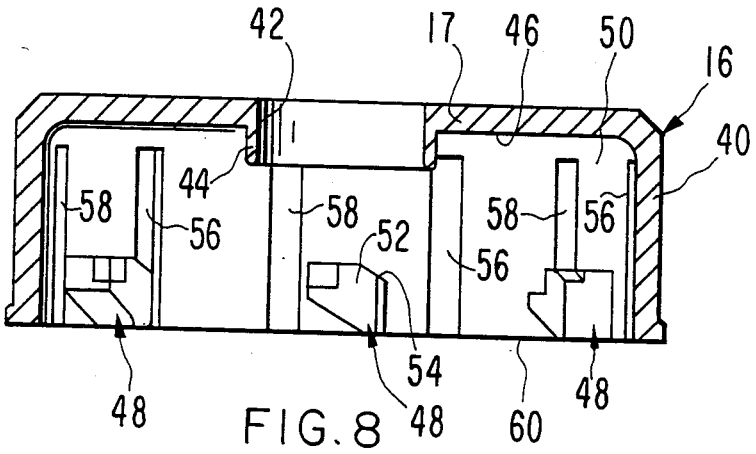
Figure 9:
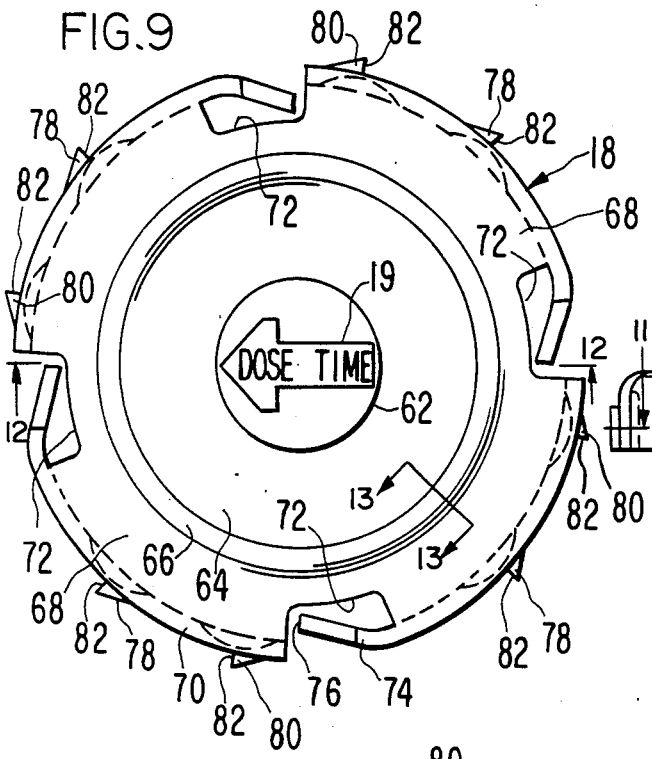
Figure 10:
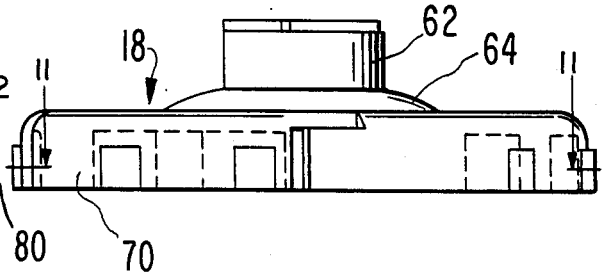
Figure 11:
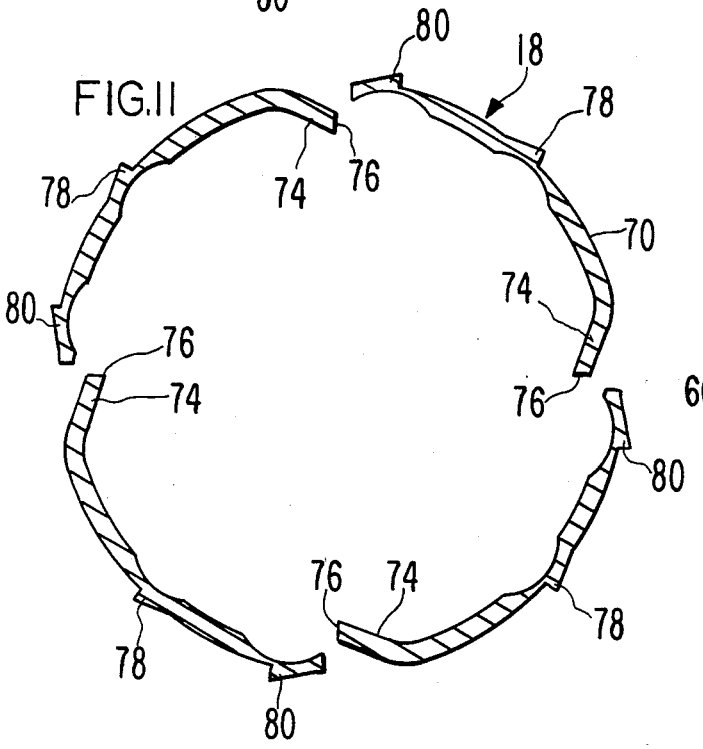
Figure 13:
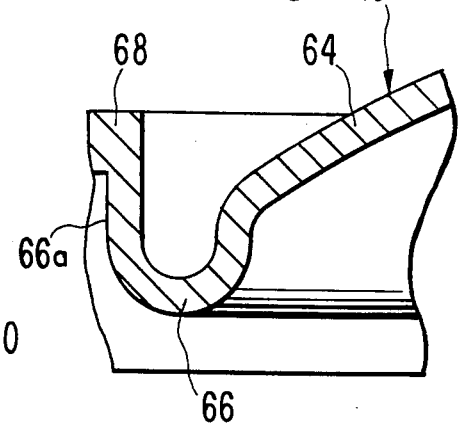
Figure 12:
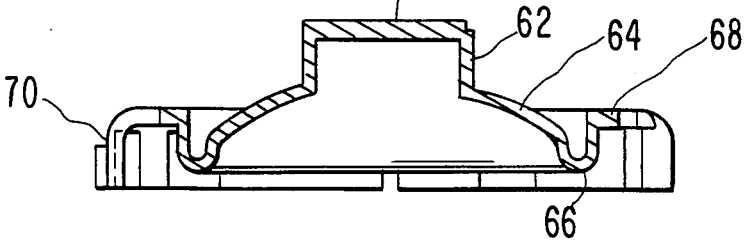

FIG. 5*a* is an enlarged, fragmentary view similar to FIG. 5 but showing a modified form of a boss on the bottle;

FIG. 6 is a top plan view of the bottle;

FIG. 7 is a horizontal section through the outer cap;

FIG. 8 is a vertical section through the cap;

FIG. 9 is a top plan view of the inner member;

FIG. 10 is a side elevational view of the inner member;

FIG. 11 is a cross-sectional view taken along line 11—11 of FIG. 10;

FIG. 12 is a cross-sectional view taken along line 12—12 of FIG. 9;

FIG. 13 is an enlarged, cross-sectional view taken along line 13—13 of FIG. 9.

DESCRIPTION OF THE PREFERRED EMBODIMENT

An embodiment of the medicine bottle unit of the present invention is broadly denoted by the numeral 10 and includes an open top bottle 12 and a closure 14 for the bottle. The closure is comprised of an outer cap 16 and an inner member 18 within cap 16. Closure 14 operates to indicate certain information, such as the time when medication in the bottle is to be taken by the person using medicine bottle unit 10. For instance, the bottle may contain tablets or pills which are to be taken once each day or several times per day. If once a day, cap 16 will be provided with certain indicia, such as the words "odd" and "even" to indicate the calendar days of a month or the days of a week. If the dosage is to be taken several times each day, such as at morning, noon and at night, there will be specific indicia on the cap to indicate these specific times. Other types of information can be provided depending upon the specific dosage requirements of the patient.

Closure 14 operates to advance an indicator by one increment of indicia each time the closure is replaced on the bottle 12 following the removal of a tablet or other unit of medication from the bottle. The movement of this indicator is accomplished automatically in a manner hereinafter described so that the user of bottle unit 10 will be apprised immediately or at any time after replacing closure 14 on bottle 12 of the time for the next dosage or when the last dose was taken.

FIG. 5 shows bottle 12 as being generally cylindrical; however, it can be of any shape and size. For purposes of illustration, there may be a slight taper in the bottle as the lower end is approached so that the open top of the bottle is of a slightly larger diameter than that of the bottom of the bottle.

The bottle has a number of circumferentially spaced bosses 20 thereon below the upper margin 22 of the bottle, each boss providing a safety cap feature to be used in cooperation with a corresponding boss (hereinafter described) on the inner peripheral surface of cap 16.

Each boss 20 projects laterally from the outer surface of bottle 12 and includes a central generally horizontal part 24 which extends circumferentially of the bottle, a downwardly extending vertical part 26 at one end of part 24, and a curved, upwardly extending part 28 at or near the other end of part 24. Part 28 extends to the upper edge 22 of bottle 12. Part 28 has a vertical, flat face 29, a lower, curved camming surface 30, and a flat, vertical side surface 32 extending upwardly from the lower end of surface 30. Surface 32 and a flat vertical side surface 34 on part 26 define a recess 36 for receiving a part of an adjacent boss 48 on the inner surface of cap 16 as hereinafter described. FIG. 6 shows how the bosses 20 are uniformly spaced apart and integral with the bottle.

Cap 16 has an annular side wall 40 (FIGS. 7 and 8) integral with top 17 as shown in FIG. 8. Top 17 has a circular hole 42 centrally located therein, and the top further may have an annular flange 44 which is coextensive with opening 42 and extends downwardly from the inner surface 46 of the cap.

Cap 16 has a number of bosses 48 on the inner peripheral surface 50 of side wall 40 near the lower marginal edge of the cap, there being a boss 48 for each boss 20, respectively, on bottle 12. FIG. 7 shows that there are six such bosses 48 uniformly spaced around the inner surface 50 of side wall 40 of cap 16.

Bosses 48 are integral with side wall 40, and each boss 48 has an upwardly extending projection 52 (FIGS. 7 and 8) which is adapted to be received within recess 36 (FIG. 5) of the adjacent boss 20 on bottle 12 when the cap 16 is releasably coupled to the bottle to close the bottle and provide a safety cap feature therefor.

In placing cap 16 on bottle 12, bosses 48 on the cap pass downwardly through the spaces 49 (FIG. 5) between adjacent bosses 20, then an edge 54 (FIG. 8) of each boss 48 engages cam surface 30 of the adjacent boss 20 when cap 16 is rotated to the left when viewing FIG. 5. This causes projection 52 of each boss 48 to pass downwardly along surface 30 and then eventually into vertical alignment with recess 36, whereby a spring action caused by the resilience of inner member 18 in a manner hereinafter described causes projections 52 of bosses 48 to rise and enter respective recesses 36 of bosses 20. In this way, projections 52 are removably captured in the recesses and the cap cannot be rotated on the bottle until projections 52 are below and out of recesses 36. By pressing downwardly on the cap, projections 52 are moved downwardly out of recesses 36, then the cap can be rotated to the right when viewing FIG. 5 until bosses 48 are vertically aligned with the spaces 49 between adjacent bosses 20, then the cap can be raised in a straight line to allow the cap to move through spaces 49 and off the bottle. Thus, recesses 36 and projections 52 provide a safety cap feature for medicine bottle unit 10.

Other boss configurations can be used to provide the safety cap feature. For instance, rather than lifting the cap straight upwardly to remove the closure from the bottle, removal could be effected by a screw motion applied to the closure. For instance, each boss 20 on bottle 12 could have the shape shown in FIG. 5*a* wherein an inclined edge 26*a* could be provided instead of a vertical part 26 as shown in FIG. 5. By using an inclined edge, the corresponding boss will continue in a screw fashion as cap 16 is rotated on the bottle. Also, recesses 36 or projections 52 or both could be eliminated if no safety cap feature is to be provided.

Sidewall 40 of cap 16 has a plurality of pairs of grooves (FIGS. 7 and 8) on the inner surface thereof, each pair of grooves being denoted by the numeral 56 and 58. Moreover, each pair of grooves 56 and 58 extend axially of the cap and are on opposite sides of a respective boss 48 as shown in FIG. 7. Grooves 56 and 58 are saw tooth in cross section, groove 58 being closer to the corresponding boss 48 than groove 56 (FIG. 7) although grooves 56 and 58 are parallel with each other as shown in FIG. 8. The grooves extend from the lower marginal edge 60 (FIG. 8) of side wall 40 to a location spaced below but in proximity to the lower inner surface 46 of top 17 of cap 16. The grooves 56 and 58 are essentially of the same width, and each groove has a flat, generally radially extending face 61 for a purpose hereinafter described.

Inner member 18 is shown in detail in FIGS. 9–13. Member 18 includes a generally cylindrical, upper central part 62 (FIG. 10) which is at the upper end of a conical, resilient wall 64 which slopes downwardly and outwardly and terminates at a transversely U-shaped, circular part 66 (FIG. 13) for engaging the upper, inner wall surface of the bottle for sealing purposes, the upper, outer end of part 66 being connected to a horizontal, annular wall 68. An annular, downwardly extending, resilient, outer peripheral side wall 70 is integral with the outer peripheral margin of horizontal wall 68. Any conventional sealing technique could be used, including a seal separate from inner member 18.

Horizontal wall 68 is provided with four recesses 72 therein as shown in FIG. 9. Wall 70 is broken at each recess 72 and has a leg 74 which extends at an angle into a respective recess 72 as shown in FIGS. 9 and 11. Each leg 74 has a leading face 76 (FIG. 11) which is adapted to bear against the vertical face 29 on an adjacent boss 20 (FIG. 5) to prevent the rotation of inner member 18 in a direction to the left when viewing FIG. 5 when closure 14 is on bottle 12. While only four legs 74 have been shown in FIG. 9, there could be more or less than four of such legs.

The outer surface of wall 70 is provided with a number of pairs of sawtooth or wedge-shaped projections, each pair of projections being denoted by the numerals 78 and 80 as shown in FIGS. 9 and 11. Projections 78 and 80 are adapted to be complementally received within adjacent pairs of grooves 56 and 58 (FIGS. 7 and 8) in the manner shown in FIG. 3. Projections 78 and 80 have substantially the same cross section as grooves 56 and 58, and each of projections 78 and 80 has a flat face 82 (FIG. 9) which bears against the corresponding flat face 61 of the adjacent groove 56 or 58. Thus, grooves 56 and 58 and projections 78 and 80 provide a one-way clutch which allows rotation of cap 16 in one direction relative to inner member 18 and bottle 12, yet the clutch requires that the cap and inner member 18 be rotated together as a unit when the cap is moved in the opposite direction on the bottle.

Closure 14 is assembled by inserting inner member 18 in cap 16 such that the inner member nests within cap 16. When fully assembled, part 62 (FIG. 10) extends through flange 44 and opening 42 (FIG. 8) of cap 16, and the flange 44 provides a bearing for permitting rotation of part 62 relative to top 17 of cap 16. Also, conical wall 64 extends outwardly and downwardly of cap 16, and U-shaped part 66 (FIGS. 12 and 13) has a generally annular, axially extending outer face 66*a* (FIG. 13) which is adapted to be in sealing engagement as shown in FIG. 2 with the upper margin 22 of the bottle when closure 14 is on the bottle.

Figure 2:
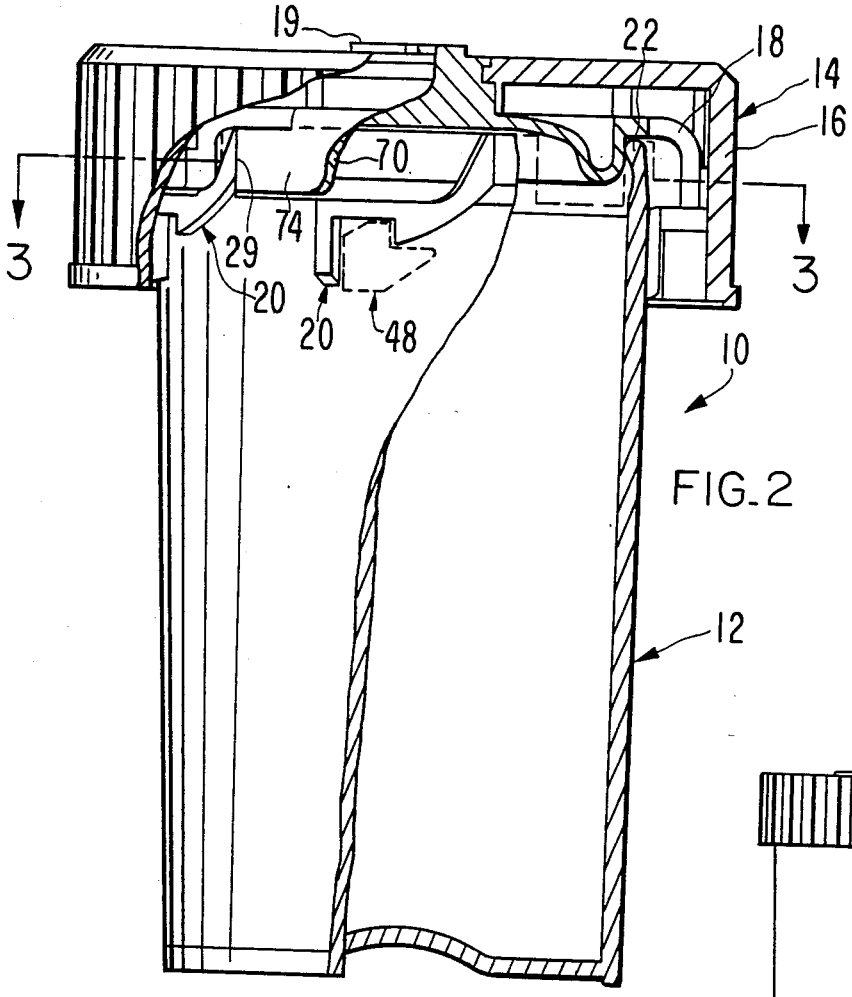
FIG. 2 is an enlarged, side elevational view of the medicine bottle unit, parts being broken away and in section to show details of the bottle, the outer cap, and the inner member within the outer cap.
Figure 1:
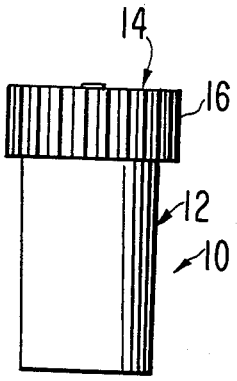
FIG. 1 is a side elevational view of a medicine bottle unit having the improved closure of the present invention thereon.

When closure 14 is in closing relationship to bottle 12, projections 52 on bosses 48 on the inner surface of cap 16 will be received within recesses 36 as shown in FIG. 2. Thus, the closure 14 will be releasably locked on bottle 12 because the bosses 48 will engage the adjacent vertical parts 26. Thus, parts 26 define stops to prevent further rotation of closure 14 relative to the bottle. This stop feature is used on all embodiments of the invention which are disclosed hereinafter. This stop feature, however, is not limited to this precise structure.

Figure 3:
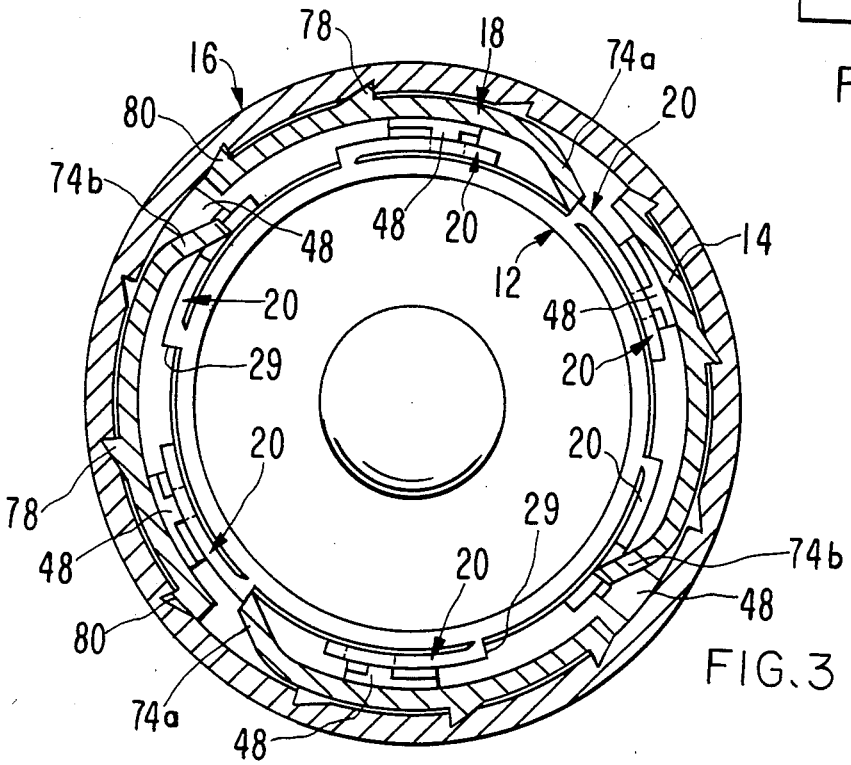
FIG. 3 is a cross-sectional view taken along line 3—3 of FIG. 2.

When this locking action occurs, the outer ends 76 of two of the four legs 74 (FIGS. 9 and 11) will be in engagement with the vertical surfaces 29 of adjacent bosses 20 as shown in FIGS. 2 and 3. These legs 74 will be diametrically opposed to each other, FIG. 3 showing legs 74*a* being in engagement with adjacent bosses 20 while legs 74*b* are spaced from surfaces 29 of the bosses 20 next adjacent thereto.

When cap bosses 48 engage the adjacent bosses 20, then cap 16 must be pressed downwardly and then rotated in a counterclockwise sense when viewing FIG. 3 to open bottle 12 so as to gain access to the contents thereof. However, as shown in FIG. 3, projections 78 and 80 on inner member 18 are received in adjacent grooves 56 and 58 and are arranged to prevent rotation of cap 16 relative to inner member 18 in a counterclockwise sense. Thus, inner member 18 must rotate with cap 16 in a counterclockwise sense when viewing FIG. 3 until bosses 48 (FIGS. 7 and 8) are aligned with the spaces 49 (FIG. 5) between bosses 20 on bottle 12. Then, the cap and the inner member can be removed from the bottle as a unit by moving the cap axially and away from the bottle.

When it is desired to replace closure 14 on the bottle, the cap is lowered onto the top of the bottle and, when this occurs, bosses 48 move through the spaces 49 (FIG. 5) between adjacent bosses 20, then the the cap is rotated in a clockwise sense when viewing FIG. 3 so as to cause bosses 48 on the cap to move downwardly along adjacent cam surfaces 30 of bosses 20 until projections 52 of bosses 48 are vertically aligned with the adjacent recesses 36. The cap is then released and springs upwardly due to the resilience of wall 64, causing the projections 52 to enter adjacent recesses 36.

When cap 16 is placed on the bottle, a pair of diametrically opposed legs 74, such as legs 74*a* of FIG. 3, will immediately engage surfaces 29 of adjacent bosses 20. Thus, as cap 16 is rotated in a clockwise sense when viewing FIG. 3 to replace the cap on the bottle, legs 74*a* will prevent rotation of inner member 18 relative to bottle 12. Cap 16 can then rotate relative to the inner member 18 and the bottle since projections 78 and 80 will slip out of the adjacent grooves 56 and 58 and allow rotation of cap 16 relative to inner member 18 through an angle until the projections 78 and 80 then snap back into the next pair of grooves 56 and 58. When this occurs, however, top 17 of cap 16 rotates relative to indicator 19 so that the indicator, in effect, moves to the next indicia on the upper surface of the cap and the bottle unit 10 will then indicate to the user certain dosage information, such as when the next dosage is to be taken or the time when the last dose was taken.

When the next dose is to be taken, the user presses downwardly on the cap, forcing projections 52 out of recesses 36 and the cap is then rotated in a counterclockwise sense when viewing FIG. 3 so that the cap can then be removed from the bottle. Cap 16 and inner member 18 move together during this cap removal operation because of the way projections 78 and 80 are in grooves 56 and 58. The foregoing steps are repeated periodically every time a dosage time period occurs.

While the above description relates to the use of the safety cap feature for medicine bottle unit 10, it is also possible to elminate such feature, if desired. The only change would be to elminate recesses 36 or projections 52 (FIGS. 7 and 8) on bosses 48. Thus, without projections, the cap would not be required to be pressed downwardly and then rotated in order to open the bottle.

We claim:

1. A medicine bottle unit comprising: a bottle having an open top; and a closure for the open top thereof, the closure including a hollow cap and an inner member within the cap, said cap being rotatable in opposite directions relative to the bottle to open and close the bottle, said cap and said inner member having relatively shiftable indicia thereon, the inner member having first means for holding it in a fixed position on the bottle as the cap is rotated in one direction relative to the bottle, the inner member having second means permitting it to be movable with the cap as the cap rotates relative to the bottle in the opposite direction, the bottle having a first boss and the cap having a second boss cooperating with the first boss to releasably hold the cap on the bottle, said bosses being movable out of engagement with each other as the cap rotates relative to the bottle permit removal of the cap and inner member from the bottle, said first means engaging the boss of the bottle to prevent rotation of the inner member relative to the bottle as said cap is rotated in said one direction relative to the bottle.

2. A medicine bottle unit as set forth in claim 1, wherein the inner member has an outer periphery, said second means including a projection extending laterally of said outer periphery, the cap having a skirt with an axially extending peripheral groove on the inner surface of the cap for removably receiving the projecting on the inner member, said groove and projection cooperating with each other to prevent rotation of the inner member relative to the cap when the cap is rotated in said one direction on the bottle and to allow movement of the inner member relative to the cap when the cap is rotated in the opposite direction on the bottle.

3. A medicine bottle unit as set forth in claim 2, wherein the projection is wedge-shaped, the groove having a shape complemental to the projection.

4. A medicine bottle unit as set forth in claim 3, wherein the inner member has an outer peripheral wall, said wall having the projection thereon and being yieldable to allow the projection of the inner member to move out of the groove of the cap as the cap and inner member move relative to each other.

5. A medicine bottle unit as set forth in claim 1, wherein the cap has a top, said top having an lower surface, said inner member having an upper surface adjacent to the lower surface of the top, one of the surfaces having a plurality of saw-tooth groove, the other surface having a projection removably received within any one of the grooves, said projection defining said second means.

6. A medicine bottle unit as set forth in claim 1, wherein the runner member has an annular, transversely U-shaped part, the outer margin of the part being in sealing relationship to said bottle when the closure is on the bottle.

7. A medicine bottle unit as set forth in claim 1, wherein the inner member has an outer periphery, there being a number of spaced projections extending laterally of said outer periphery and defining said second means, the cap having a number of spaced inner peripheral grooves for removably receiving the adjacent projections on the inner member, said grooves and projections cooperating to prevent rotation of the cap relative to the inner member when the cap is rotated in said one direction on the bottle and to allow relative movement of the cap and inner member when the cap rotates in the opposite direction on the bottle.

8. A medicine bottle unit as set forth in claim 7, wherein each projection is wedge-shaped, the groove having a shape complemental to the projections.

9. A medicine bottle unit as set forth in claim 8, wherein the inner member has an outer peripheral wall, said wall having said projection thereon being yieldable to allow the projections of the inner member to move out of the grooves of the cap as the cap and inner member move relative to each other.

10. A medicine bottle unit comprising: a bottle having an upper margin, an open top and a closure for the top, said closure including a hollow cap and an inner member within the cap, the bottle having a number of circumferentially spaced first bosses on the upper margin thereof, said cap having an inner peripheral surface with a number of circumferentially spaced second bosses thereon, each second boss being movable into engagement with and beneath a respective one of said first bosses to releasably interconnect the cap and the bottle as the cap is moved in a first direction relative to the bottle, the cap having a number of circumferentially spaced grooves in the inner peripheral surface thereof, said inner member having an outer peripheral surface, there being a number of lateral projections on said outer peripheral surface of the inner member, the projection being removably receivable within the grooves of the cap, said grooves and projections defining a clutch permitting rotation of the cap relative to the inner member when the cap rotates in said first direction relative to the bottle and permitting rotation of the cap and inner member together when the cap is rotated in the opposite direction relative to the bottle, said inner member having means engageable with at least one of said first bosses of the bottle for preventing rotation of the inner member relative to the bottle when the cap is rotated in said first direction, said cap having a hole in the top thereof, said inner member having a mounting part rotatably receivable in the hole, there being relatively shiftable indicia on the cap and inner member.

11. A medicine bottle unit as set forth in claim 10, wherein the hole through the cap is centrally located therein.

12. A medicine bottle as set forth in claim 10, wherein the hole is off-center relative to the axis of the cap.

13. A medicine bottle as set forth in claim 11, wherein the inner member having a rivet like central part coupled to the cap and providing a bearing permitting rotation of the inner member relative to the cap.

14. A medicine bottle unit as set forth in claim 10, wherein the grooves extend axially of the central axis of the cap.

15. A medicine bottle as set forth in claim 10, wherein the grooves and projections are transversely wedged-shaped.

16. A medicine bottle unit as set forth in claim 13, wherein the inner member has an outer, axially extending wall, the projections being on the outer surface of said outer wall, said outer wall being yieldably coupled to the remaining part of the inner member to allow the projections to move out of the grooves as the cap and inner member move relative to each other.

17. A medicine bottle unit as set forth in claim 10, wherein the preventing means comprises a plurality of circumferentially spaced legs on the outer periphery of the inner member, at least one of said legs engaging at least one of said first bosses on said bottle to prevent rotation of the inner member on the bottle when said cap is rotated in said first direction relative to the bottle.

18. A medicine bottle unit as set forth in claim 17, wherein each first projection has an axially extending surface near the open top of the bottle, each leg having an axially extending edge engageable with the bearing surface of the adjacent first boss.

19. A medicine bottle unit as set forth in claim 17, wherein each leg extends inwardly at an acute angle from the outer periphery of the inner member.

20. A medicine bottle unit as set forth in claim 17, wherein the inner end of each leg is transversely V-shaped.

* * * * *